US011952695B2

(12) United States Patent
Davis

(10) Patent No.: US 11,952,695 B2
(45) Date of Patent: Apr. 9, 2024

(54) WASHING MACHINE APPLIANCE HAVING A REMOVABLE AGITATOR

(71) Applicant: Haier US Appliance Solutions, Inc., Wilmington, DE (US)

(72) Inventor: Paul Owen Davis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 401 days.

(21) Appl. No.: 17/371,360

(22) Filed: Jul. 9, 2021

(65) Prior Publication Data

US 2023/0011849 A1 Jan. 12, 2023

(51) Int. Cl.

| | |
|---|---|
| ***D06F 13/02*** | (2006.01) |
| ***D06F 17/10*** | (2006.01) |
| ***D06F 23/04*** | (2006.01) |
| ***D06F 37/12*** | (2006.01) |
| ***D06F 37/24*** | (2006.01) |
| ***D06F 37/26*** | (2006.01) |

(52) U.S. Cl.

CPC ..... *D06F 13/02* (2013.01); *D06F 17/10* (2013.01); *D06F 23/04* (2013.01); *D06F 37/12* (2013.01); *D06F 37/24* (2013.01); *D06F 37/267* (2013.01)

(58) Field of Classification Search

CPC ..... D06F 13/00; D06F 13/02; D06F 13/04; D06F 13/06; D06F 13/08; D06F 17/06; D06F 17/10; D06F 21/06; D06F 21/08; D06F 23/04; D06F 37/20

See application file for complete search history.

(56) References Cited

U.S. PATENT DOCUMENTS

| | | | | |
|---|---|---|---|---|
| 2019/0062978 | A1* | 2/2019 | Czarnecki | D06F 31/00 |
| 2021/0062382 | A1 | 3/2021 | Andrejczuk et al. | |
| 2022/0235512 | A1* | 7/2022 | Bixby | D06F 13/02 |
| 2022/0275554 | A1* | 9/2022 | Patel | D06F 13/02 |

FOREIGN PATENT DOCUMENTS

| | | | |
|---|---|---|---|
| CN | 203729101 | U | 7/2014 |
| CN | 204898347 | U | 12/2015 |

* cited by examiner

*Primary Examiner* — Joseph L. Perrin

(74) *Attorney, Agent, or Firm* — Dority & Manning, P.A.

(57) ABSTRACT

A washing machine appliance may include a tub, a basket, an impeller base, and an extended post. The impeller base may include one or impeller fins and a mounting face. The mounting face may include a threaded bracket defining a mounting thread extending about a rotation axis. The mounting face may define a vertical slot radially inward from the mounting thread. The extended post may be removably attached to the impeller base to rotate therewith. The extended post may include a base body, an auger fin, and a mating face. The base body may extend between a bottom end and a top end. The auger fin may extend radially from the base body. The mating face may be disposed on the bottom end. The mating face may define a mating thread matched to the mounting thread to rotatably enmesh therewith.

20 Claims, 11 Drawing Sheets

WASHING MACHINE APPLIANCE HAVING A REMOVABLE AGITATOR

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub, and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Different agitation elements typically come with different advantages and disadvantages. In the case of single-action and dual-action agitation elements, users may perceive greater agitation and turnover of articles during a washing operation or cycle than with an impeller agitation element. In the case of impeller agitation elements, a greater volume or portion of the wash basket may be available or better able to handle bulky items (e.g., towels, bedding, etc.) than a single-action or dual-action agitation element.

Generally, a consumer or user has to decide which type of agitation element would be most desired at the time of purchase. This obviously limits the user's choice and ability to wash various loads. As a result, it would be useful if a user could have greater flexibility, particularly with regard to the type of agitation element that is used for any given washing operation or wash cycle. Therefore, it would be advantageous to provide a washing machine appliance or assembly wherein an agitation element (or portions thereof) could be readily removed between discrete washing operations or wash cycles (e.g., by a user without the use of any tools). Additionally or alternatively, it may be advantageous to provide an agitation element with a readily identifiable identifier to indicate when the agitation element is properly installed (e.g., within the basket or tub of the washing machine appliance).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a tub, a basket, an impeller base, and an extended post. The basket may be rotatably positioned within the tub. The impeller base may be rotatably mounted within the basket and define a rotation axis. The impeller base may include one or impeller fins extending radially outward from the rotation axis and a mounting face. The mounting face may be disposed radially inward from the one or more impeller fins. The mounting face may include a threaded bracket defining a lower mounting thread (LMT) segment and an upper mounting thread (UMT) segment. The LMT segment and the UMT segment may extend separately about the rotation axis. The extended post may be removably attached to the impeller base to rotate therewith. The extended post may include a base body, an auger fin, and a mating face. The base body may extend along the rotation axis between a bottom end proximal to the impeller base and a top end distal to the impeller base. The auger fin may extend radially from the base body between the bottom end and the top end. The mating face may be disposed on the bottom end. The mating face may define a lower mating thread (LAT) segment and an upper mating thread (UAT) segment. The LAT segment may be matched to the LMT segment to rotatably enmesh therewith. The UAT segment may be matched to the UMT segment to rotatably enmesh therewith.

In another exemplary aspect of the present disclosure, a washing machine appliance is provided. The washing machine appliance may include a tub, a basket, an impeller base, an extended post, and a connector bar. The basket may be rotatably positioned within the tub. The impeller base may be rotatably mounted within the basket and define a rotation axis. The impeller base may include one or impeller fins extending radially outward from the rotation axis and a mounting face. The mounting face may be disposed radially inward from the one or more impeller fins. The mounting face may include a threaded bracket defining a mounting thread extending about the rotation axis. The mounting face may define a vertical slot radially inward from the mounting thread. The extended post may be removably attached to the impeller base to rotate therewith. The extended post may include a base body, an auger fin, and a mating face. The base body may extend along the rotation axis between a bottom end proximal to the impeller base and a top end distal to the impeller base. The auger fin may extend radially from the base body between the bottom end and the top end. The mating face may be disposed on the bottom end. The mating face may define a mating thread matched to the mounting thread to rotatably enmesh therewith. The connector bar may slidably extend within the extended post along the rotation axis between a lower end and an upper end. The lower end may include a connector tab slidably received within the vertical slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
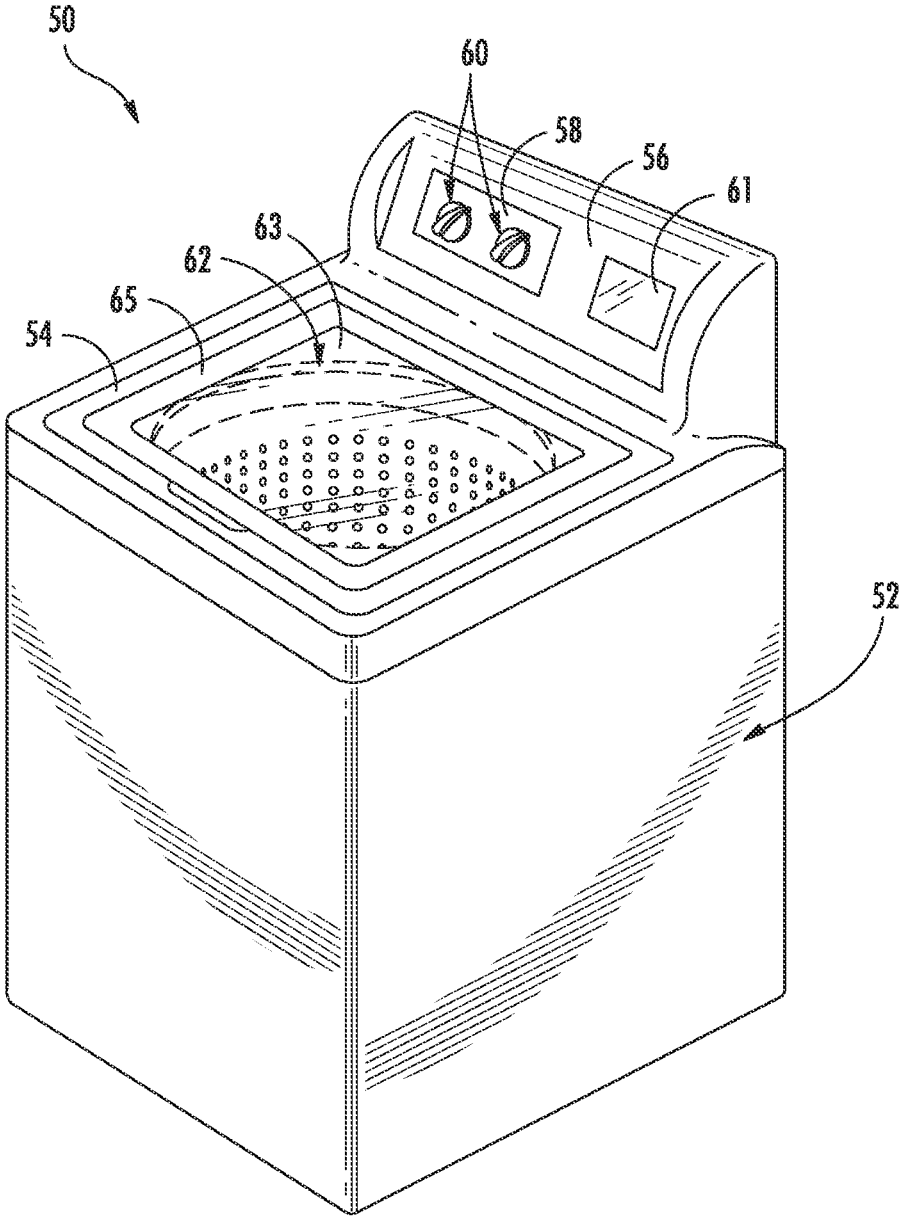
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
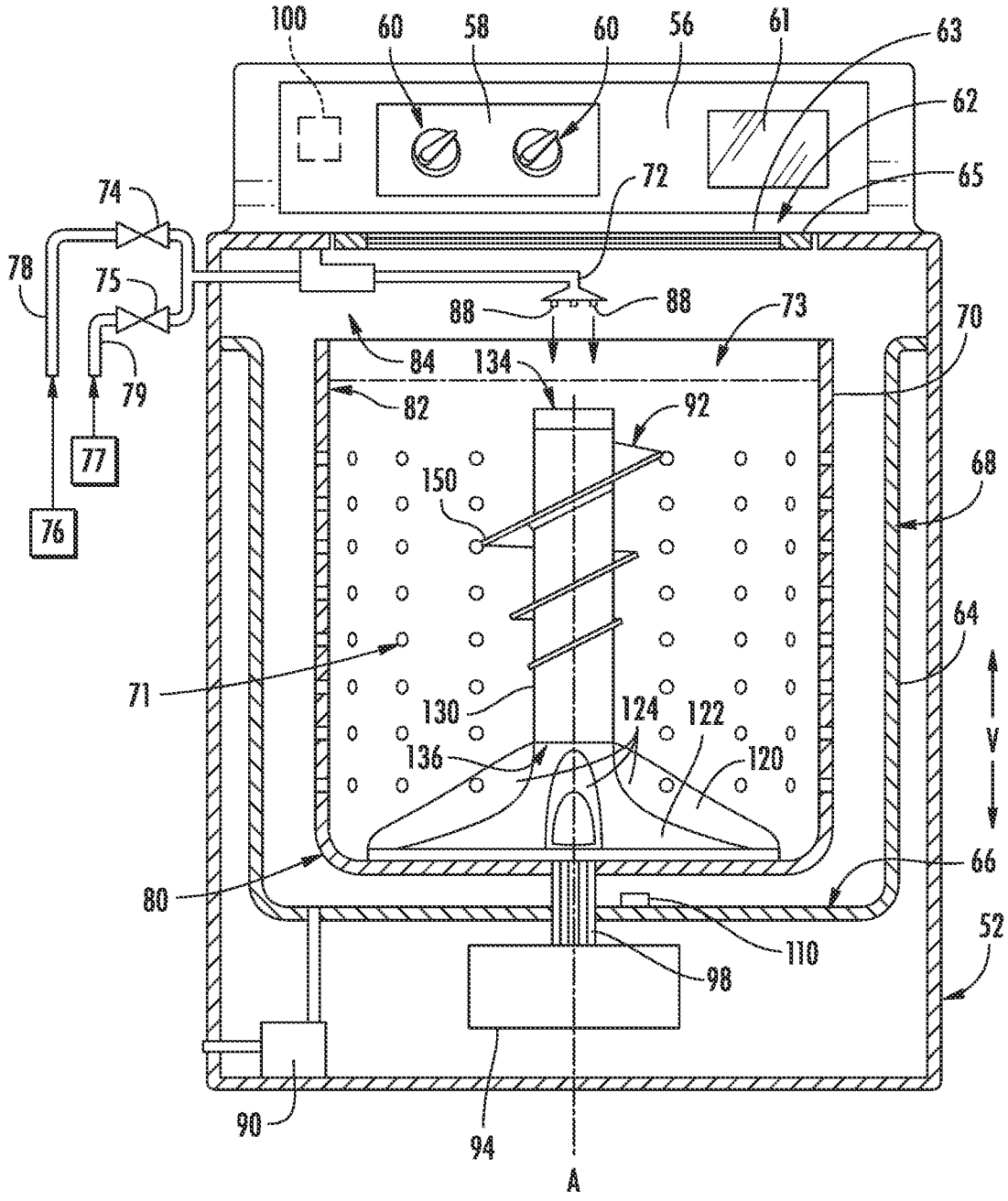
FIG. 2 provides a sectional elevation view of the exemplary washing machine appliance of FIG. 1.
Figure 3:
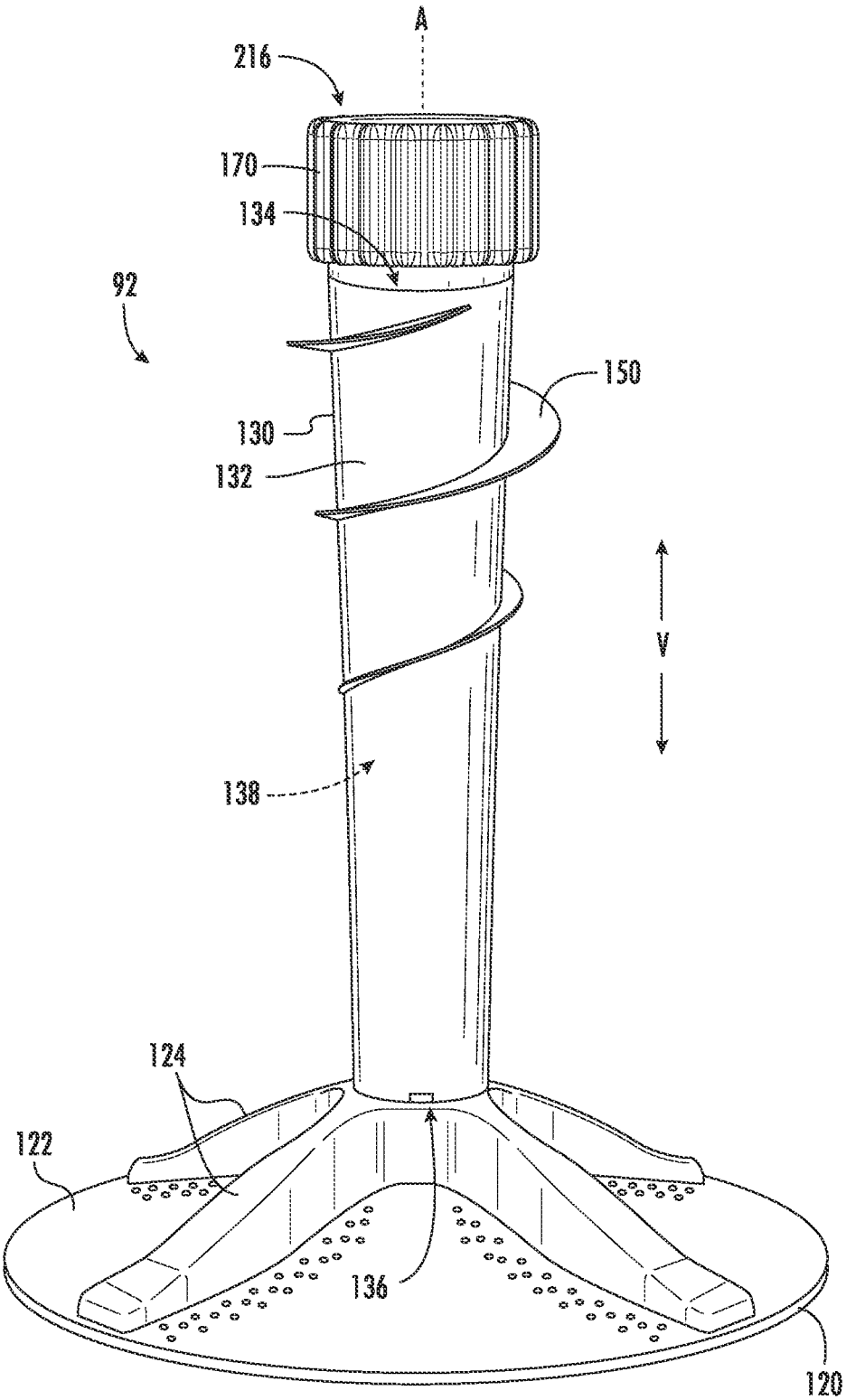
FIG. 3 provides a perspective view of an agitation element, in isolation, according to exemplary embodiments of the present disclosure.
Figure 4:
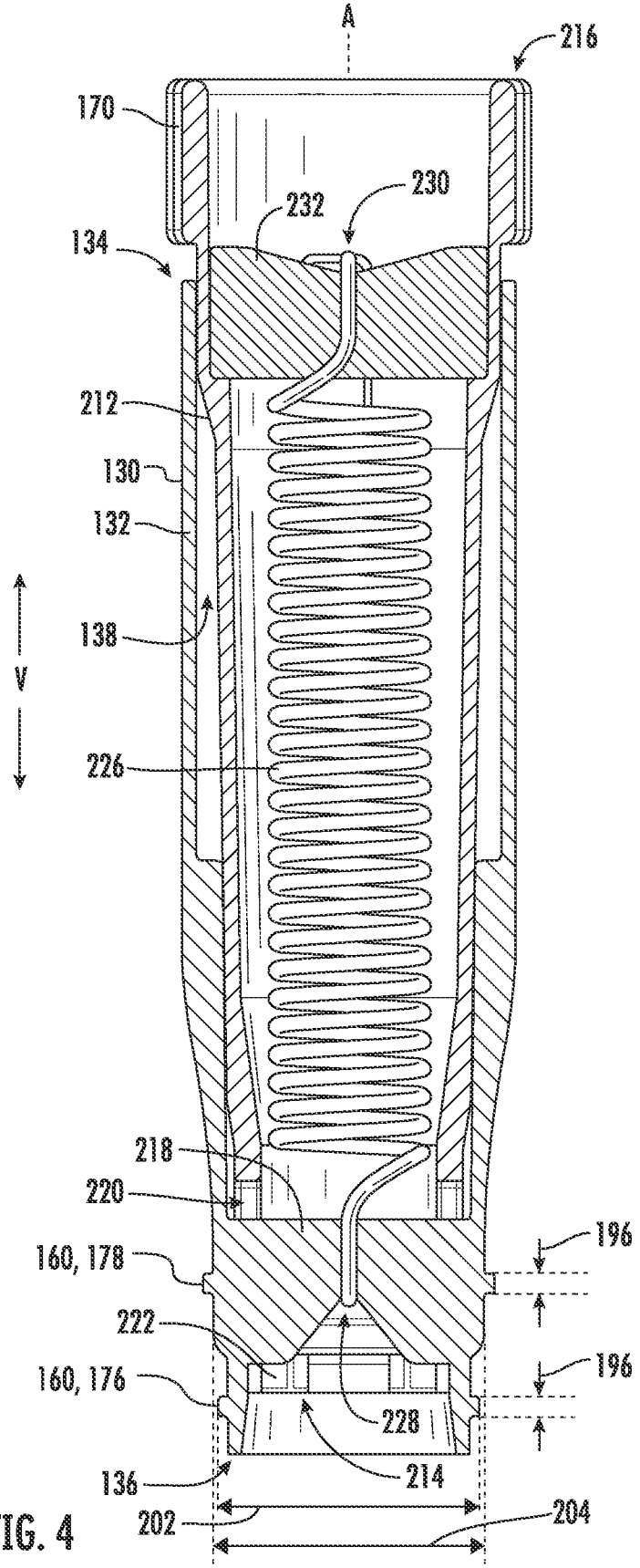
FIG. 4 provides a sectional elevation view of an extended post of the exemplary agitation element of FIG. 3.
Figure 5:
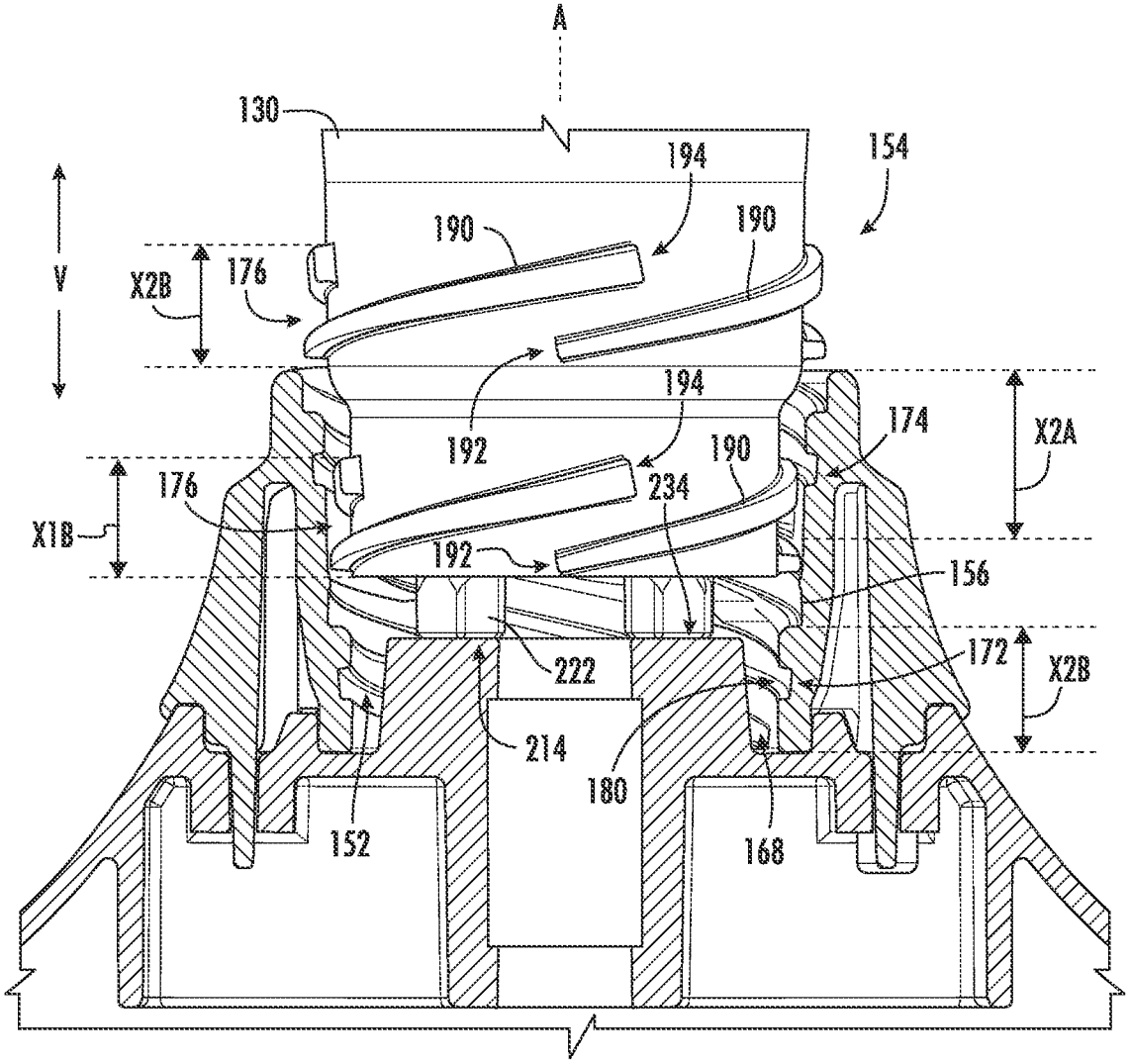
FIG. 5 provides a sectional elevation view of a portion of the impeller base of the exemplary agitation element of FIG. 3, wherein the extended post is received therein FIG. 6 provides an elevation view of a bottom portion of the extended post of the exemplary agitation element of FIG. 3.
Figure 6:
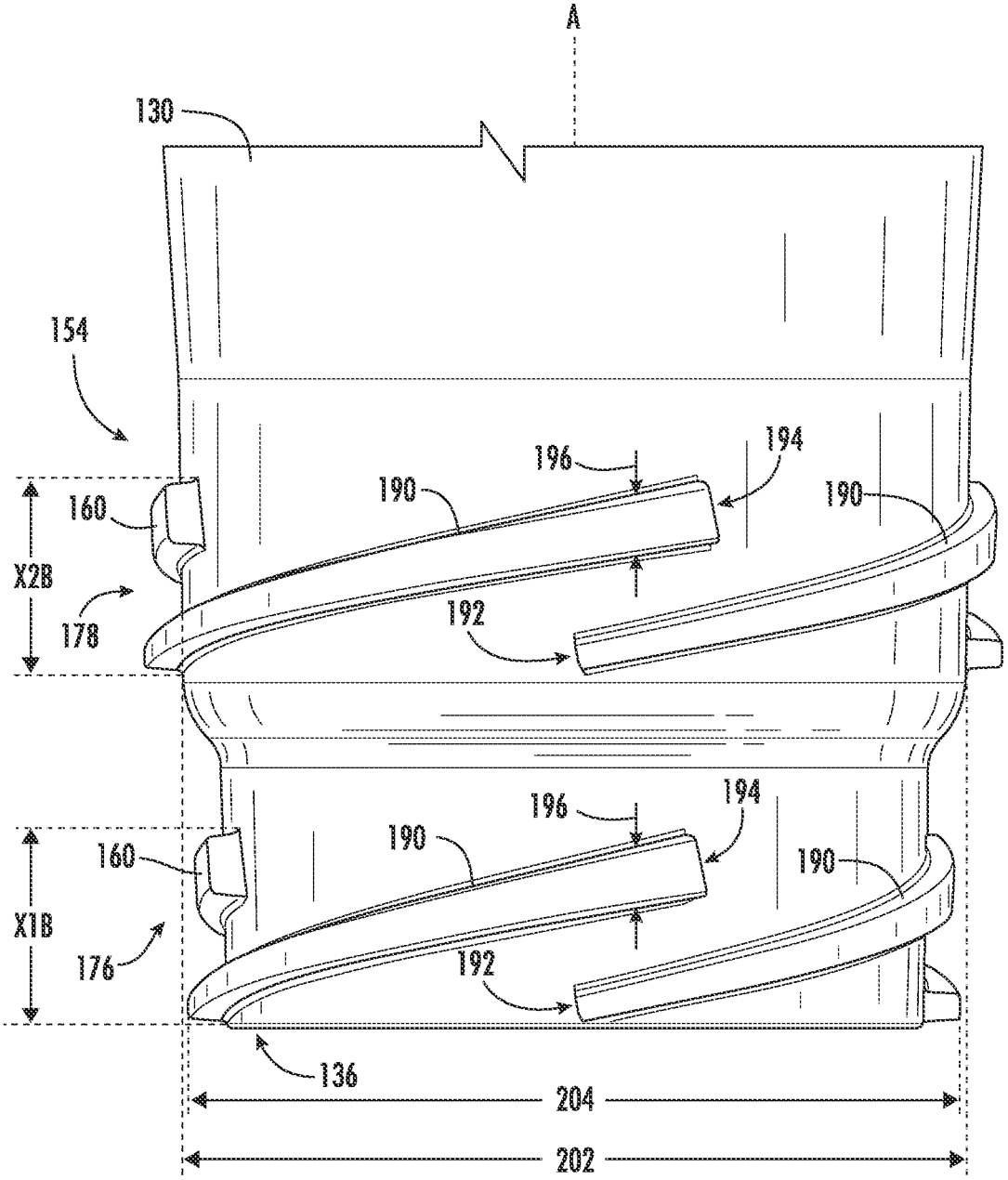
Figure 7:
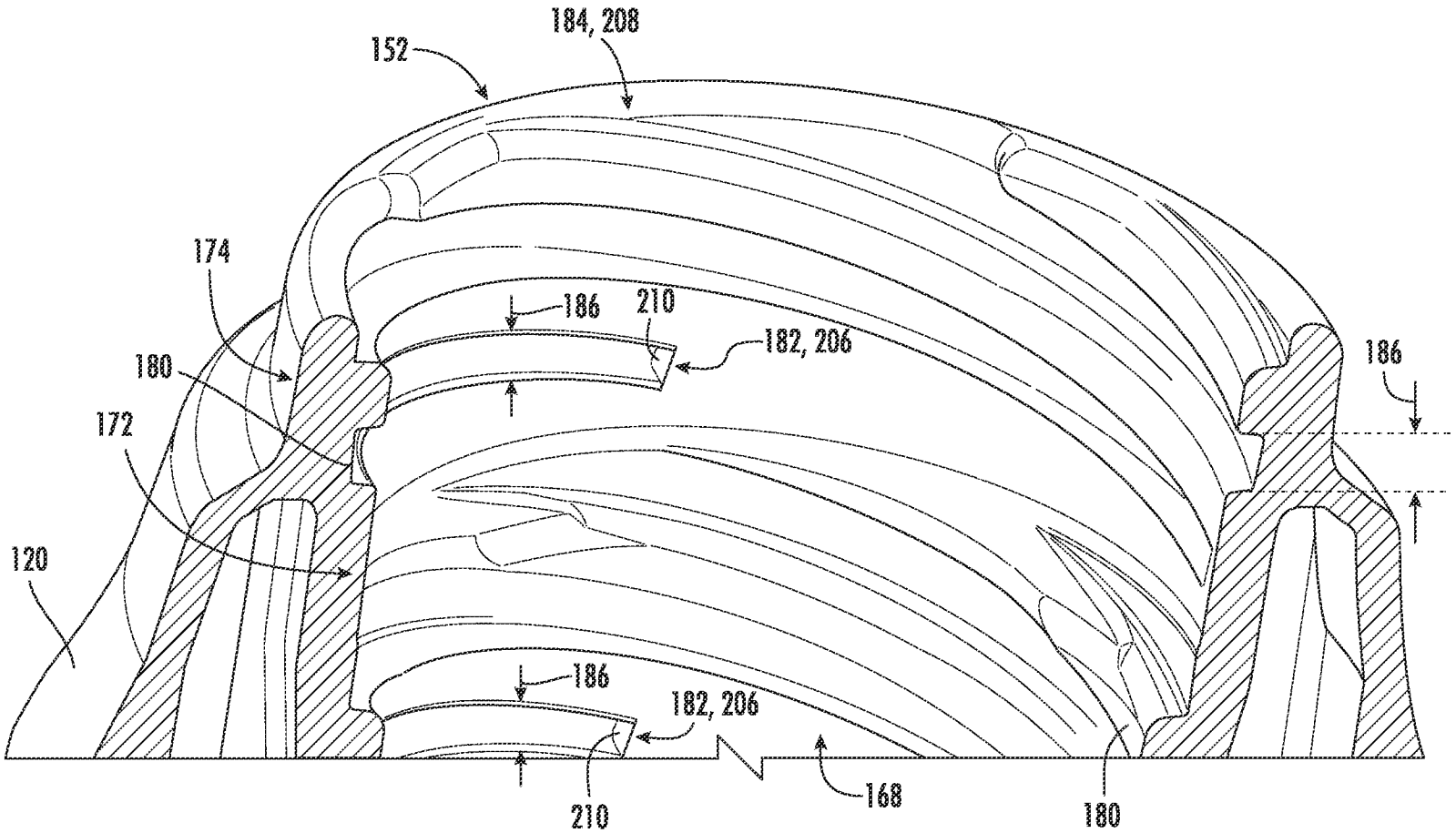
FIG. 7 provides a sectional perspective view of a portion of the impeller base of the exemplary agitation element of FIG. 3.
Figure 8:
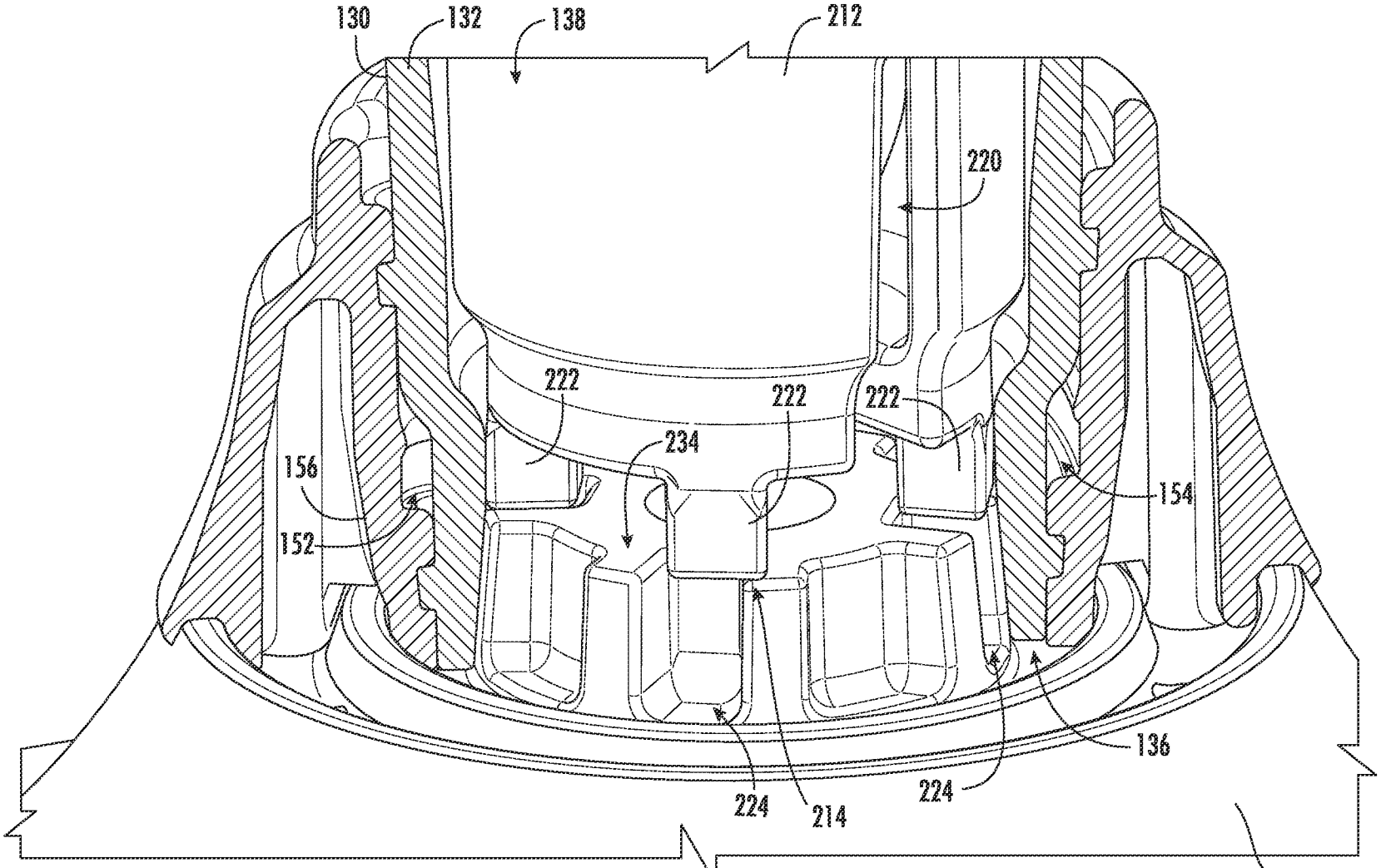
FIG. 8 provides a sectional perspective view of a portion of the impeller base of the exemplary agitation element of FIG. 3, wherein the extended post and connector bar are received therein in an unsecured position.
Figure 9:
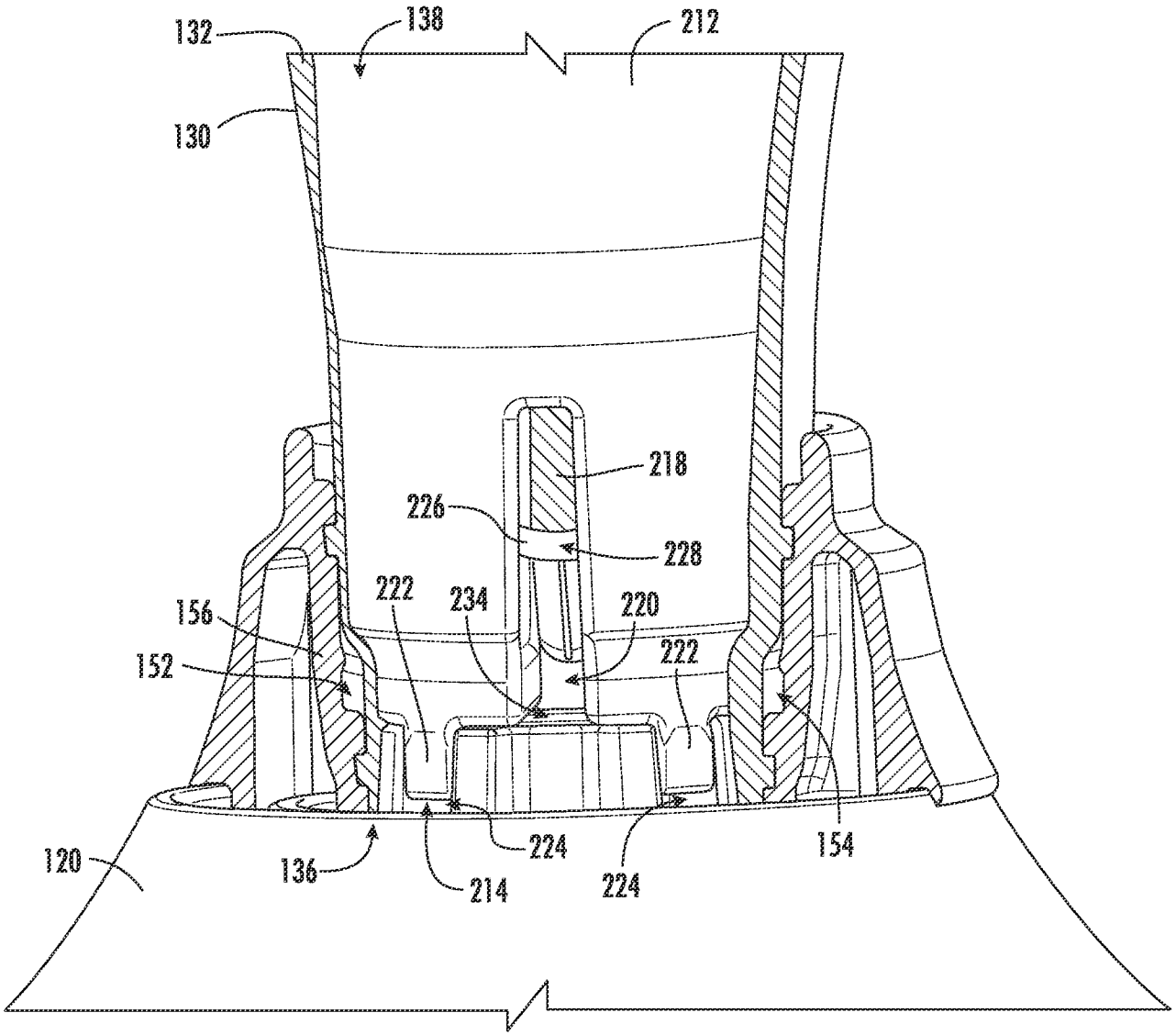
FIG. 9 provides a sectional perspective view of a portion of the impeller base of the exemplary agitation element of FIG. 3, wherein the extended post and connector bar are received therein in a secured position.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail herein, an agitation element 92 is oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 11, agitation element 92 may include or be provided as a removable agitation element having an extended post 130 selectively attached to (and removable from) impeller base 120. Generally, impeller base 120 includes an impeller platform 122 having one or more impeller fins 124 extending therefrom, as would generally be understood. In the illustrated embodiments, impeller base 120 includes four discrete impeller fins 124 that extends upward from impeller platform 122 and radially outward from rotation axis A. Nonetheless, it is understood that any suitable number of impeller fins 124 may be provided. When assembled, impeller base 120 is generally connected to or in mechanical communication with motor 94, such as through the output shaft 98. Thus, impeller base 120 may be rotated, oscillated, or otherwise motivated by motor 94 (e.g., during a washing operation or wash cycle, as directed by controller 100).

When assembled, extended post 130 may generally extend along the rotation axis A above the impeller base 120. Specifically, extended post 130 may include a base body 132 extending along the rotation axis A between a bottom end 136 and a top end 134. As shown, base body 132 may be mounted within wash chamber 73 such that bottom end 136 is attached or otherwise proximal to the impeller base 120 while top end 134 is held distal to impeller base 120. Between top end 134 and bottom end 136, one or more auger fins 150 may extend radially from extended post 130 (e.g., to engage and agitate articles within wash chamber 73). In the illustrated embodiments, auger fin 150 is formed as a helical coil wrapped about extended post 130. Nonetheless, any suitable shape or number of auger fins may be provided in alternative embodiments, as would be understood. Moreover, it is noted that although no auger fin is visible in FIGS. 4 through 11, this is merely for the purposes of illustration and should not be understood as not providing any auger fin or otherwise limiting the present disclosure.

Turning especially to FIGS. 5 through 9, impeller base 120 may provide a mounting face 152 that selectively connects to a mating face 154 of extended post 130. As shown, mounting face 152 is disposed inward from the impeller fins 124. Thus, mounting face 152 may be located closer to rotation axis A than impeller fins 124. In some such embodiments, mounting face 152 is generally coaxial with rotation axis A (e.g., at a radial center of impeller base 120).

At or within mounting face 152, impeller base 120 may include a threaded bracket 156 that defines a mounting thread 158 (e.g., one or more segments thereof). As shown, the mounting thread 158 generally extends about the rotation axis A or a central passage 168 defined by threaded bracket 156 (e.g., parallel to the rotation axis A). Thus, mounting thread 158 may follow an arcuate or helical path that surrounds or extends about rotation axis A. In some embodiments, the mounting thread 158 includes or is provided as multiple discrete mounting thread segments that extend separately from each other and are, thus, discontinuous with each other. For instance, threaded bracket 156 may define a lower mounting thread (LMT) segment 172 and an upper mounting thread (UMT) segment 174. Each of LMT segment 172 and UMT segment 174 may extend separately about the rotation axis A. For instance, LMT segment 172 may extend across a first axial distance X1A while UMT segment 174 extends across a second axial distance X2A (e.g., disposed above the first axial distance X1A).

In certain embodiments, multiple discrete threads 180 are included with one or both of LMT segment 172 or UMT segment 174. As shown, such discrete threads 180 of a corresponding segment 172 or 174 may be provided in parallel to each other. Two or more discrete threads 180 may extend from a separate lower thread tip 182 to a separate upper thread tip 184. Additionally or alternatively, two or more discrete threads 180 of a corresponding segment 172 or 174 may be circumferentially spaced apart. Optionally, such discrete threads 180 may be circumferentially stacked. In other words, the lower thread tip 182 of one (e.g., first) discrete thread 180 may be positioned circumferentially forward from or in alignment with the upper thread tip 184 of another (e.g., second) discrete thread 180 of the same corresponding segment 172 or 174. Thus, at least a portion of the first discrete thread 180 will be disposed directly beneath a portion of the second discrete thread 180.

Optionally, mounting thread 158 (e.g., one or more segments thereof) has a variable axial thickness 186. In some embodiments, LMT segment 172 has a variable axial thickness 186. Specifically, LMT segment 172 may vary along the first axial distance X1A. For instance, along the first axial distance X1A from the lower thread tip 182 to the upper thread tip 184, the axial thickness 186 of LMT segment 172 may generally increase relative to proximity to upper thread tip 184. Contrarily, the axial thickness 186 of LMT segment 172 may generally decrease along the first axial distance X1A relative to proximity to lower thread tip 182. In turn, the axial thickness 186 of LMT segment 172 at the upper thread tip 184 may be larger than the axial thickness 186 of LMT segment 172 at the lower thread tip 182. Optionally, the major thread diameter of LMT segment 172 (e.g., maximum diameter of central passage 168 along the first axial distance X1A) may remain constant along the first axial distance X1A. The minor thread diameter may be constant or, alternatively, varied along the first axial distance X1A. Additionally or alternatively, the pitch of LMT segment 172 (i.e., spacing between adjacent crests of a corresponding thread or its extrapolated path) may be constant along the first axial distance X1A.

In additional or alternative embodiments, UMT segment 174 has a variable axial thickness 186. Specifically, UMT segment 174 may vary along the second axial distance X2A. For instance, along the second axial distance X2A from the lower thread tip 182 to the upper thread tip 184, the axial thickness 186 of UMT segment 174 may generally increase relative to proximity to upper thread tip 184. Contrarily, the axial thickness 186 of UMT segment 174 may generally decrease along the second axial distance X2A relative to proximity to lower thread tip 182. In turn, the axial thickness 186 of UMT segment 174 at the upper thread tip 184 may be larger than the axial thickness 186 of UMT segment 174 at the lower thread tip 182. Optionally, the major thread diameter of UMT segment 174 (e.g., maximum diameter of central passage 168 along the second axial distance X2A) may remain constant along the second axial distance X2A. The minor thread diameter may be constant or, alternatively, varied along the second axial distance X2A. Additionally or alternatively, the pitch of UMT segment 174 (i.e., spacing between adjacent crests of a corresponding thread or its extrapolated path) may be constant along the second axial distance X2A.

Extended post 130 may provide a complementary structure to engage or interlock with the mounting face 152 of impeller base 120. In some embodiments, extended post 130 includes a mating face 154 disposed on bottom end 136 to rest against or interlock with the mounting face 152. Specifically, mating face 154 may define a mating thread 160 matched to the mounting thread 158 to rotatably enmesh therewith. In other words, mating thread 160 is defined as the complementary thread to mounting thread 158 and can screw thereon such that extended post 130 and impeller base 120 can rotate in tandem with axial movement along rotation axis A (e.g., within central passage 168). Thus, mating thread 160 may include or more matched threading dimension (e.g., axial thread thickness, pitch, major diameter, minor diameter, lead, etc.) as mounting thread 158. Advantageously, the engagement or enmeshing of mating thread 160 and mounting thread 158 may form a selective, self-locking, friction-fit connection between impeller base 120 and extended post 130.

As a result of the complementary relationship between mating thread 160 and mounting thread 158, in some embodiments, mating thread 160 includes or is provided as multiple discrete mating thread segments that extend separately from each other and are, thus, discontinuous with each other. For instance, mating face 154 may define a lower mating thread (LAT) segment 176 and an upper mating thread (UAT) segment 178. Each of LAT segment 176 and UAT segment 178 may extend separately about the rotation axis A. For instance, LAT segment 176 may extend across a first axial distance X1B while UAT segment 178 extends across a second axial distance X2B (e.g., disposed above the first axial distance X1B). Moreover, the LAT segment 176 may be matched to the LMT segment 172 to rotatably enmesh therewith while the UAT segment 178 may be matched to the UMT segment 174 to rotatably enmesh therewith.

In certain embodiments, multiple discrete threads 190 are included with one or both of LAT segment 176 and UAT segment 178. As shown, such discrete threads 190 of a corresponding segment 176 or 178 may be provided in parallel to each other. Two or more discrete threads 190 may extend from a separate lower thread tip 192 to a separate upper thread tip 194. Additionally or alternatively, two or more discrete threads 190 of a corresponding segment 176 or 178 may be circumferentially spaced apart. Optionally, such discrete threads 190 may be circumferentially stacked. In other words, the lower thread tip 192 of one (e.g., first) discrete thread 190 may be positioned circumferentially forward from or in alignment with the upper thread tip 194 of another (e.g., second) discrete thread 190 of the same corresponding segment 176 or 178.

Advantageously, mating thread 160 having multiple discrete threads 190 may require a relatively short circumferential path or rotation requirement in order to secure extended post 130 to impeller base 120.

Optionally, mating thread 160 (e.g., one or more segments thereof) has a variable axial thickness 196. In some embodiments, LAT segment 176 has a variable axial thickness 196. Specifically, LAT segment 176 may vary along the first axial distance X1B. For instance, along the first axial distance X1B from the lower thread tip 192 to the upper thread tip 194, the axial thickness 196 of LAT segment 176 may generally increase relative to proximity to upper thread tip 194. Contrarily, the axial thickness 196 of LAT segment 176 may generally decrease along the first axial distance X1B relative to proximity to lower thread tip 192. In turn, the axial thickness 196 of LAT segment 176 at the upper thread tip 194 may be larger than the axial thickness 196 of LAT segment 176 at the lower thread tip 192.

In certain embodiments, the minor thread diameter of LAT segment 176 (e.g., minimum diameter of mating face 154 along the first axial distance X1B) remains constant along the first axial distance X1B. The major thread diameter (e.g., outer maximum diameter of mating face 154 along the first axial distance X1B) may be constant or, alternatively, varied along the first axial distance X1B. As shown, the minor thread diameter of the LAT segment 176 defines a maximum outer thread diameter 204. Optionally, the pitch of LAT segment 176 (i.e., spacing between adjacent crests of a corresponding thread or its extrapolated path) may be constant along the first axial distance X1B.

In additional or alternative embodiments, UAT segment 178 has a variable axial thickness 196. Specifically, UAT segment 178 may vary along the second axial distance X2B. For instance, along the second axial distance X2B from the lower thread tip 192 to the upper thread tip 194, the axial thickness 196 of UAT segment 178 may generally increase relative to proximity to upper thread tip 194. Contrarily, the axial thickness 196 of UAT segment 178 may generally decrease along the second axial distance X2B relative to proximity to lower thread tip 192. In turn, the axial thickness 196 of UAT segment 178 at the upper thread tip 194 may be larger than the axial thickness 196 of UAT segment 178 at the lower thread tip 192.

In certain embodiments, the minor thread diameter of UAT segment 178 (e.g., minimum diameter of mating face 154 along the first axial distance X1B) remains constant along the first axial distance X1B. As shown, the minor thread diameter of UAT segment 178 may define a maximum inner thread diameter 202. The major thread diameter (e.g., outer maximum diameter of mating face 154 along the second axial distance X2B) may be constant or, alternatively, varied along the second axial distance X2B. Optionally, the pitch of UAT segment 178 (i.e., spacing between adjacent crests of a corresponding thread or its extrapolated path) may be constant along the second axial distance X2B.

As noted above, mating thread 160 (e.g., including LAT segment 176 and UAT segment 178) may be matched to the mounting thread 158 (e.g., at LMT segment 172 and UMT segment 174, respectively) such that mating face 154 can screw onto mounting face 152 within central passage 168. As shown, the maximum outer thread diameter 204 of the LAT segment 176 may be less than or equal to the maximum inner thread diameter 202 of the UAT segment 178. This relationship may be mirrored by the LMT segment 172 and the UMT segment 174, as indicated above. In turn, the LAT segment 176 may translate or slide (e.g., vertically or axially) within the UMT segment 174 without being required to rotate. Thus, insertion of the mating face 154 to the mounting face 152 may be guided, advantageously promoting proper alignment between the corresponding male-female threads.

In order to receive the corresponding portions of mating thread 160, mounting thread 158 (e.g., each segment thereof) may include one or more female threads 180 that extend from a leading end 206 to an open trailing end 208 (e.g., axially or vertically open). In some embodiments, one or more threads 180 of mounting thread 158 may define an axial abutment wall 210 at the leading end 206. For instance, LMT segment 172 (i.e., one or more female threads 180 thereof) may include axial abutment wall 210 at the leading end 206 thereof. The axial abutment wall 210 may provide an abrupt end to the arcuate or helical path of mounting thread 158 as a flat surface extending along the axial direction and radially inward from the major diameter of the mounting thread 158. For instance, the axial abutment wall 210 may have a depth greater than or equal to 1 millimeter. Advantageously, axial abutment wall 210 may prevent a taper-lock condition, which may otherwise occur with accidental overtightening or excessive rotation of mating face 154 within mounting face 152.

As noted above, extended post 130, including base body 132 may be mounted within wash chamber 73. In particular, extended post 130 may be mounted such that bottom end 136 is attached or otherwise proximal to the impeller base 120 (e.g., via mounting thread 158 and mating thread 160 engagement) while top end 134 is held distal to impeller base 120.

Turning especially to FIGS. 4 and 8 through 11, a connector bar 212 may be provided to selectively restrict movement of extended post 130 relative to impeller base 120 (e.g., circumferential or radial movement when mounted). As shown, connector bar 212 may be disposed generally along the rotation axis A from a lower end 214 and an upper end 216. At least a portion of connector bar 212 may be received within an interior cavity 138 defined by base body 132. Additionally or alternatively, connector bar 212 may be rotationally fixed relative to base body 132. For instance, an internal anchor 218 of base body 132 may extend radially through interior cavity 138. Optionally, internal anchor 218 may provide a longitudinal post or rail bisecting interior cavity 138. As shown, connector bar 212 may define an anchor slot 220 within which internal anchor 218 is received. When received within anchor slot 220, internal anchor 218 may be radially bounded on opposite sides by the walls of connector bar 212 that define anchor slot 220. In turn, rotation of connector bar 212 (e.g., about rotation axis A) may cause the walls of anchor slot 220 to simultaneously rotate base body 132 in kind.

In some embodiments, connector bar 212 includes or is attached to an enlarged handle 170 (e.g., textured or scalloped grip cap). Specifically, textured or scalloped enlarged handle 170 may be disposed at or proximal to top end 134. Thus, extended post 130 may define enlarged handle 170 at upper end 216 (e.g., above top end 134). As shown, enlarged handle 170 may extend about rotation axis A and generally define an outer diameter of extended post 130. In turn, a user may notably be able to hold and rotate enlarged handle 170 relative to impeller base 120 as extended post 130 is being attached to or removed from impeller base 120 (e.g., moved between an unsecured position, such as in FIGS. 5 and 8, and a secured position, such as in FIG. 9).

When extended post 130 is attached to impeller base 120 (e.g., in the secured position), connector bar 212 may be received within an interior cavity 138 defined by base body 132. Specifically, one or more connector tabs 222 (e.g., vertical tabs) of connector bar 212 may slidably engage a portion of the impeller base 120 (e.g., below internal anchor 218) such that the connector tab 222 holds the extended post 130 against the impeller base 120. Such connector tabs 222 may be formed or disposed at the lower end 214. Thus, when assembled such that extended post 130 is attached to impeller base 120, lower end 214 may be disposed proximal to the impeller base 120 while upper end 216 is disposed above lower end 214, distal to impeller base 120.

In certain embodiments, mounting face 152 defines one or more vertical slots 224 to receive a corresponding connector tab 222 (e.g., such that each connector tab 222 is received within a discrete corresponding vertical slot 224). Optionally, multiple vertical slots 224 may be defined at separate locations about the rotation axis A such that each vertical slot 224 is circumferentially spaced and discontinuous from the adjacent vertical slot(s) 224 about the rotation axis A. As shown, the vertical slots 224 may be located radially inward from the mounting thread 158 (e.g., at the LMT segment 172 and the UMT segment 174). When moving from an unsecured position to the secured position, the connector tabs 222 may thus move (e.g., vertically inward) within mounting face 152 without engaging or contacting mounting thread 158. Moreover, each connector tab 222 may slide vertically into a corresponding vertical slot 224. When extended post 130 is attached to impeller base 120 such that the connector tabs 222 are received within the vertical slots 224, the connector tabs 222 may thus be held within the vertical slots 224. Advantageously, the extended post 130 may, in turn, resist external loads (e.g., generated by articles within wash chamber 73) and maintain the vertical position of extended post 130 relative to impeller base 120.

In certain embodiments, connector bar 212 is spring-loaded to slide or translate (e.g., along rotation axis A) relative to a portion of extended post 130. Specifically, connector bar 212 may be slidably attached, at least in part, to extended post 130 (e.g., at base body 132) by a biasing spring 226. Generally, biasing spring 226 may be in mechanical communication with both extended post 130 and connector bar 212. In turn, biasing spring 226 may bias connector bar 212 downward (e.g., toward impeller base 120). In some such embodiments, biasing spring 226 is held within both interior cavity 138 and an internal open cavity of connector bar 212. Opposite ends of biasing spring 226 may be secured (e.g., hooked, tied, clipped, directly joined, etc.) to base body 132 and connector bar 212, respectively. For instance, an anchor end 228 of biasing spring 226 may be secured to base body 132 (e.g., at internal anchor 218) while a displacing end 230 is secured to connector bar 212 (e.g., at a bar rail 232 extending on or within connector bar 212). In use, anchor end 228 may thus remain stationary relative to extended post 130 while displacing end 230 moves (e.g., axially or vertically) with connector bar 212 relative to extended post 130.

It is noted that although biasing spring 226 is illustrated as a coiled tension spring, any suitably spring may be provided to biased connector bar 212 downward (e.g., compression spring, torsion spring, leaf spring, gas/hydraulic spring, etc.), as would be understood in light of the present disclosure.

The spring-loaded arrangement of connector bar 212 may serve, at least in part, to provide a visual or tactile indication that extended post 130 is fully installed or attached to impeller base 120. Specifically, connector bar 212 may indicate if or when extended post 130 is in an unsecured mounting position and a secured mounting position relative to impeller base 120. In other words, the relative position of connector bar 212 on extended post 130 may differ from the unsecured mounting position to the secured mounting position. In some such embodiments, the connector tabs 222 may serve to motivate connector bar 212 upward prior to reaching the secured mounting position. In the unsecured position (e.g., prior to enmeshing of the mating thread 160 with the mounting thread 158), the connector tabs 222 may be circumferentially offset from the vertical slots 224. Moreover, the connector tabs 222 may engage with an elevated surface 234 of mounting face 152 (e.g., circumferentially disposed between the vertical slots 224). Thus, the connector tabs 222, and connector bar 212 generally, may be pushed upward. Although mating thread 160 may be permitted to rotate along mounting thread 158, thereby driving extended post 130 downward, connector bar 212 may be prevented from moving lower by the engagement or contact between the connector tabs 222 and elevated surface 234. In a secured mounting position, however, the connector tabs 222 may circumferentially align with the vertical slots 224 and, thus, be received therein. This may, in turn, permit the connector bar 212 to snap down.

Figure 10:
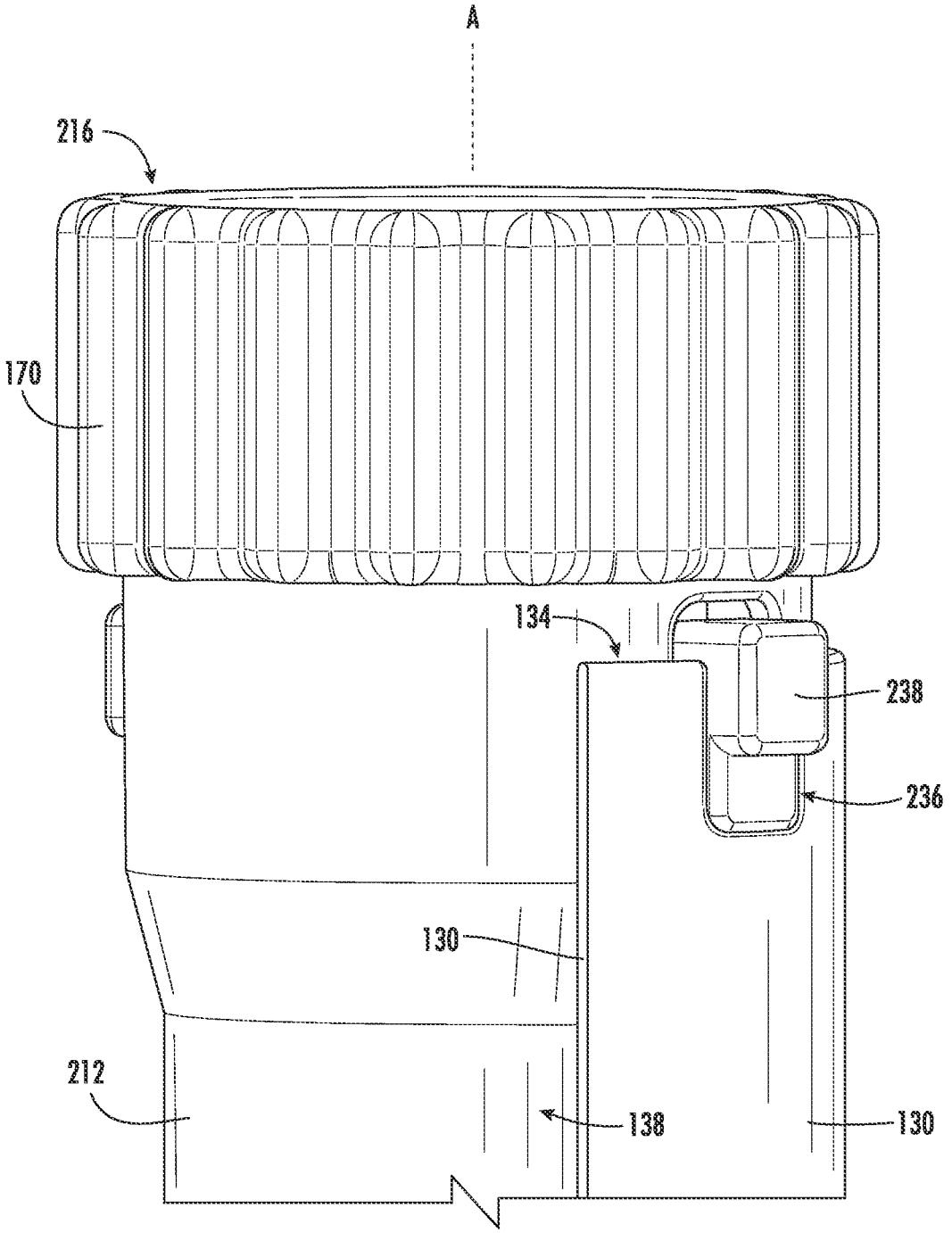
FIG. 10 provides a perspective view of a top portion of the exemplary extended post and connector bar of FIG. 3 in the unsecured position.
Figure 11:
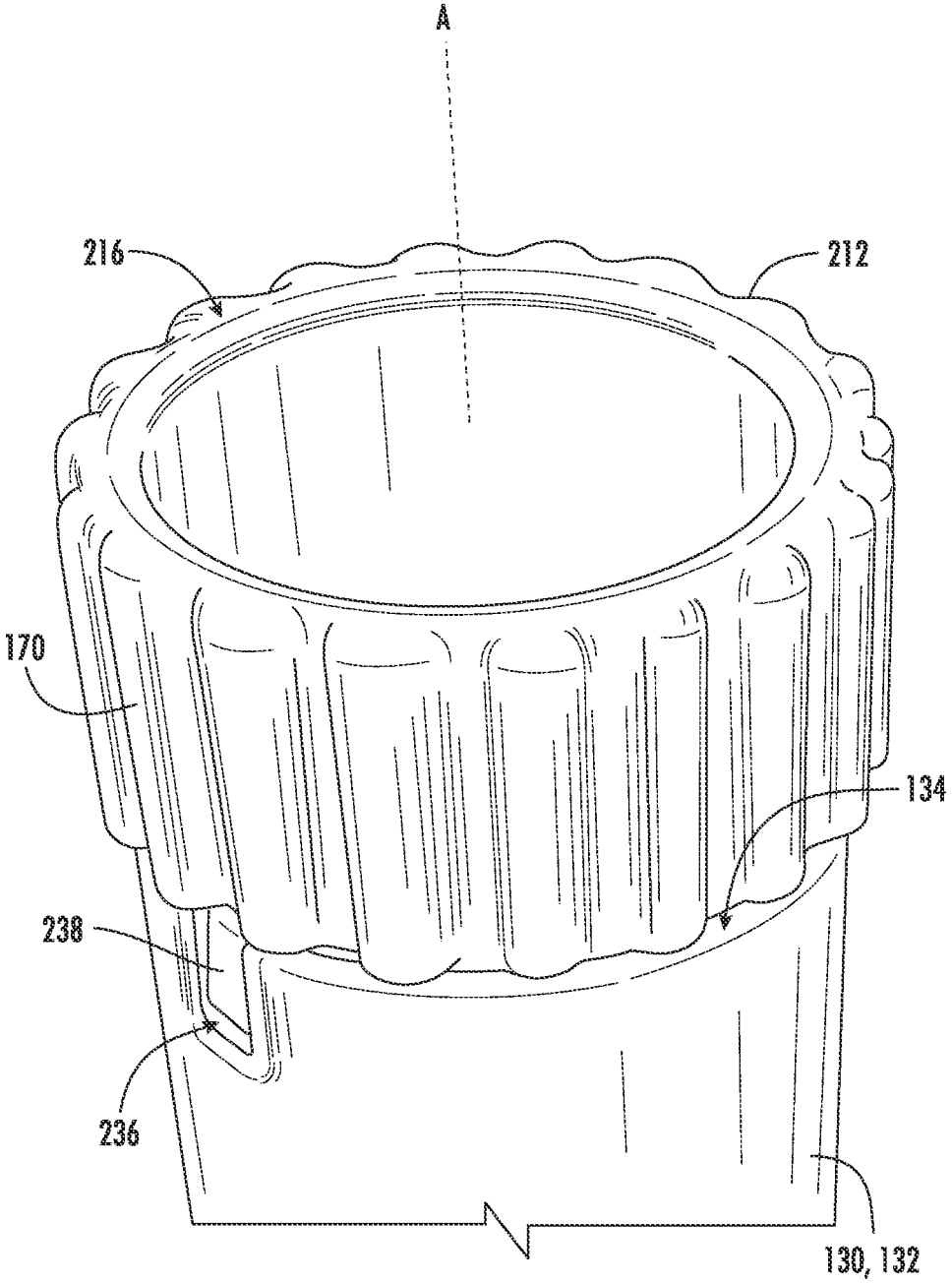
FIG. 11 provides a perspective view of a top portion of the exemplary extended post and connector bar of FIG. 3 in the secured position.

Along with generally being indicated by the relative height of connector bar 212 (e.g., at enlarged handle 170) on extended post 130, the mounting position of extended post 130 may be indicated by a radially-articulated tab. In particular, extended post 130 may define a view channel 236 that selective receives or is aligned with a radial tab 238 of connector bar 212 to indicate the relative mounting position (e.g., unsecured or secured) of the connector bar 212 relative to the extended post 130. As shown, especially in FIGS. 10 and 11, view channel 236 may extend axially and radially (e.g., through base body 132) above the mating face 154 (e.g., extending from or at top end 134), as shown in FIG. 10. Radial tab 238 may be slidably aligned with the view channel 236. In the unsecured position, the radial tab 238 may be held within view channel 236 (e.g., above the base or lower apex of the view channel 236), as shown in FIG. 11. In the secured position, the radial tab 238 may, by contrast, be moved downward (e.g., proximal to the base or lower apex of the view channel 236). Optionally, radial tab 238 may be biased radially outward along a ramped surface extending below radial tab 238. Moving to the secured position may force the radial tab 238 to move (e.g., pivot) radially inward away from view channel 236 (e.g., as the base body 132 engages a higher portion of the ramped surface), further indicating the connector bar 212 in the secured position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a tub;

a basket rotatably positioned within the tub;

an impeller base rotatably mounted within the basket and defining a rotation axis, the impeller base comprising one or more impeller fins extending radially outward from the rotation axis, and a mounting face disposed radially inward from the one or more impeller fins, the mounting face comprising a threaded bracket defining a lower mounting thread (LMT) segment and an upper mounting thread (UMT) segment, the LMT segment and the UMT segment extending separately about the rotation axis; and an extended post removably attached to the impeller base to rotate therewith, the extended post comprising a base body extending along the rotation axis between a bottom end proximal to the impeller base and a top end distal to the impeller base, an auger fin extending radially from the base body between the bottom end and the top end, and a mating face disposed on the bottom end, the mating face defining a lower mating thread (LAT) segment and an upper mating thread (UAT) segment, the LAT segment being matched to the LMT segment to rotatably enmesh therewith, and the UAT segment being matched to the UMT segment to rotatably enmesh therewith.

2. The washing machine appliance of claim 1, wherein the LAT segment has a maximum outer thread diameter, wherein the UAT segment has a maximum inner thread diameter, and wherein the maximum outer thread diameter of the LAT segment is less than or equal to the maximum inner thread diameter of the UAT segment.

3. The washing machine appliance of claim 1, wherein the LAT segment has a variable axial thickness.

4. The washing machine appliance of claim 1, wherein the UAT segment has a variable axial thickness.

5. The washing machine appliance of claim 1, wherein the LAT segment comprises a plurality of discrete threads.

6. The washing machine appliance of claim 1, wherein the LMT segment comprises a discrete female thread extending from a leading end to an open trailing end to receive a discrete male thread of the LAT segment, and wherein the discrete female thread comprises an axial abutment wall at the leading end to halt the discrete male thread.

7. The washing machine appliance of claim 1, wherein the mounting face defines a vertical slot radially inward from the LMT and UMT segments, and wherein the washing machine appliance further comprises a connector bar slidably extending within the extended post along the rotation axis between a lower end and an upper end, the lower end comprising a connector tab slidably received within the vertical slot.

8. The washing machine appliance of claim 7, wherein the connector bar comprises a plurality of connector tabs circumferentially spaced apart and discontinuous from each other about the rotation axis, and wherein the connector tab is a first tab of the plurality of connector tabs.

9. The washing machine appliance of claim 7, further comprising a biasing spring attached to the extended post within the extended post, the biasing spring being in mechanical communication with the connector bar and biasing the connector bar downward.

10. The washing machine appliance of claim 9, wherein the biasing spring extends between an anchored end secured to the extended post and a displacing end secured to the connector bar.

11. The washing machine appliance of claim 7, wherein the base body of the extended post defines a view channel extending axially and radially above the mating face, and wherein the connector bar comprises a radial tab slidably aligned with the view channel to indicate a relative mounting position of the connector bar relative to the extended post.

12. The washing machine appliance of claim 7, wherein the connector bar comprises a handle at the upper end, and wherein the handle is held above the top end of the base body.

13. The washing machine appliance of claim 7, wherein the connector bar is rotationally fixed relative to the extended post.

14. A washing machine appliance comprising:

a tub;

a basket rotatably positioned within the tub;

an impeller base rotatably mounted within the basket and defining a rotation axis, the impeller base comprising one or more impeller fins extending radially outward from the rotation axis, and a mounting face disposed radially inward from the one or more impeller fins, the mounting face comprising a threaded bracket defining a mounting thread extending about the rotation axis, the mounting face defining a vertical slot radially inward from the mounting thread;

an extended post removably attached to the impeller base to rotate therewith, the extended post comprising a base body extending along the rotation axis between a bottom end proximal to the impeller base and a top end distal to the impeller base, an auger fin extending radially from the base body between the bottom end and the top end, and a mating face disposed on the bottom end, the mating face defining a mating thread matched to the mounting thread to rotatably enmesh therewith; and a connector bar slidably extending within the extended post along the rotation axis between a lower end and an upper end, the lower end comprising a connector tab slidably received within the vertical slot.

15. The washing machine appliance of claim 14, wherein the connector bar comprises a plurality of connector tabs circumferentially spaced apart and discontinuous from each other about the rotation axis, and wherein the connector tab is a first tab of the plurality of connector tabs.

16. The washing machine appliance of claim 14, further comprising a biasing spring attached to the extended post within the extended post, the biasing spring being in mechanical communication with the connector bar and biasing the connector bar downward.

17. The washing machine appliance of claim 16, wherein the biasing spring extends between an anchored end secured to the extended post and a displacing end secured to the connector bar.

18. The washing machine appliance of claim 14, wherein the base body of the extended post defines a view channel extending axially and radially above the mating face, and wherein the connector bar comprises a radial tab slidably aligned with the view channel to indicate a relative mounting position of the connector bar relative to the extended post.

19. The washing machine appliance of claim 14, wherein the connector bar comprises a handle at the upper end, and wherein the handle is held above the top end of the base body.

20. The washing machine appliance of claim 14, wherein the connector bar is rotationally fixed relative to the extended post.

* * * * *